US011268231B2

(12) United States Patent
Park

(10) Patent No.: US 11,268,231 B2
(45) Date of Patent: Mar. 8, 2022

(54) WASHING MACHINE

(71) Applicant: Samsung Electronics Co., Ltd., Suwon-si (KR)

(72) Inventor: Kyung Won Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 109 days.

(21) Appl. No.: 16/440,035

(22) Filed: Jun. 13, 2019

(65) Prior Publication Data

US 2019/0382937 A1 Dec. 19, 2019

(30) Foreign Application Priority Data

Jun. 14, 2018 (KR) ..... 10-2018-0067952

(51) Int. Cl.
*D06F 37/26* (2006.01)

(52) U.S. Cl.
CPC ..... *D06F 37/266* (2013.01)

(58) Field of Classification Search
CPC ..... D06F 37/266
See application file for complete search history.

(56) References Cited

FOREIGN PATENT DOCUMENTS

| | | | | |
|---|---|---|---|---|
| DE | 102008018731 | | 10/2009 | |
| DE | 102008018731 | A1 * | 10/2009 | ..... D06F 37/266 |
| EP | 2692935 | | 2/2014 | |
| EP | 2692935 | A1 * | 2/2014 | ..... D06F 37/266 |
| JP | 2001-162086 | | 6/2001 | |
| JP | 2011-41746 | | 3/2011 | |
| KR | 10-2004-0047196 | | 6/2004 | |
| KR | 10-2008-0002478 | | 1/2008 | |
| KR | 10-2008-0072188 | | 8/2008 | |
| KR | 10-2010-0007260 | | 1/2010 | |
| KR | 20100007260 | A * | 1/2010 | |
| KR | 10-2017-0114720 | | 10/2017 | |

OTHER PUBLICATIONS

Extended European Search Report dated Aug. 30, 2019 in European Patent Application No. 19180232.1.
International Search Report dated Oct. 8, 2019 in International Patent Application No. PCT/KR2019/007189.
Test Report of Washing Machine, Certificate No. P17222274, Samsung Electronics Co., Ltd., Retrieved from the Internet on Sep. 7, 2019: <URL: http://nemko.com/kr>, 199 pages.
European Office Communication for European Application No. 19 180 232.1 dated Jun. 9, 2021.

* cited by examiner

*Primary Examiner* — Michael E Barr
*Assistant Examiner* — Pallavi Chitta
(74) *Attorney, Agent, or Firm* — Staas & Halsey, LLP

(57) ABSTRACT

A washing machine with an improved structure capable of effectively fixing a diaphragm on a tub includes: a cabinet including a first opening; a tub positioned in the inside of the cabinet, and including a second opening and a protruding rib protruding toward a center of the second opening; a drum rotatably positioned in the inside of the tub, and including a third opening; and a diaphragm connecting the first opening with the second opening, and including a first flange and a second flange that are coupled with the tub, wherein the first flange is fixed on an outer surface of the tub and the second flange is coupled with the protruding rib such that an interval between the diaphragm and the third opening is maintained uniform.

20 Claims, 9 Drawing Sheets

WASHING MACHINE

CROSS-REFERENCE TO RELATED APPLICATIONS

This application is based on and claims priority under 35 U.S.C. § 119 to Korean Patent Application No. 10-2018-0067952, filed on Jun. 14, 2018 in the Korean Intellectual Property Office, the disclosure of which is incorporated by reference herein in its entirety.

BACKGROUND

1. Field

The disclosure relates to a washing machine, and more particularly, to a washing machine with an improved structure capable of effectively fixing a diaphragm to a tub.

2. Description of the Related Art

A washing machine is a home appliance for washing laundry, such as clothes, bedding, etc., by using electric power.

The washing machine includes a cabinet having a laundry inlet, a tub positioned in the inside of the cabinet and storing washing water, a drum rotatably positioned in the inside of the tub to wash laundry, and a door for opening and closing the laundry inlet.

A diaphragm is installed between the cabinet and the tub. The diaphragm prevents water from leaking between the cabinet and the tub, while preventing vibrations generated by rotations of the drum from being transferred to the cabinet.

During a washing operation, when the drum rotates or when the drum rotates so that laundry is inclined, the tub connected to the drum may vibrate, and while the diaphragm absorbs vibrations of the tub, the diaphragm may move or be deformed. Also, during a spin-drying operation, the tub may vibrate by high-speed rotations of the drum, and while the diaphragm absorbs vibrations of the tub, the diaphragm may move or be deformed.

If the diaphragm is not firmly fixed to the tub, the diaphragm may move excessively. In this case, an interval between the drum and the diaphragm may be widened excessively, and when laundry is caught between the drum and the diaphragm, the laundry may be damaged or the washing machine may break down.

SUMMARY

Therefore, it is an aspect of the disclosure to provide a washing machine with an improved structure for preventing a diaphragm from moving excessively.

It is an aspect of the disclosure to provide a washing machine with an improved structure for preventing an interval between a drum and a diaphragm from being widened excessively.

Additional aspects of the disclosure will be set forth in part in the description which follows and, in part, will be obvious from the description, or may be learned by practice of the disclosure.

In accordance with an aspect of the disclosure, a washing machine includes: a cabinet including a first opening; a tub positioned in the inside of the cabinet, and including a second opening and a protruding rib protruding toward a center of the second opening; a drum rotatably positioned in the inside of the tub, and including a third opening; and a diaphragm connecting the first opening with the second opening, and including a first flange and a second flange that are coupled with the tub, wherein the first flange is fixed on an outer surface of the tub and the second flange is coupled with the protruding rib such that an interval between the diaphragm and the third opening is maintained uniform.

The protruding rib may be formed along a circumference of the second opening.

The protruding rib may be formed continuously along the circumference of the second opening.

The second flange may be coupled with the protruding rib to surround the protruding rib.

The tub may further include: a tub body; and a tub lip portion extending from the tub body to participate in coupling with the diaphragm, and defining the second opening, wherein the tub lip portion includes: a first lip portion participating in coupling with the first flange; and a second lip portion participating in coupling with the second flange, and including the protruding rib and a resting rib on which the second flange coupled with the protruding rib are rested.

The resting rib may extend toward the inside of the tub from the protruding rib.

In the first lip portion, a recess may be formed in which a portion of the first flange is inserted and fixed.

The protruding rib may include: an inner surface facing the inside of the tub; and an outer surface facing the outside of the tub, and the second flange includes: a first extension portion contacting the outer surface of the protruding rib; a second extension portion contacting the inner surface of the protruding rib; and a third extension portion forming a protruding rib accommodating space accommodating the protruding rib together with the first extension portion and the second extension portion.

The washing machine may further include a fixing member fixing the first flange on the tub.

In accordance with an aspect of the disclosure, a washing machine includes: a cabinet including a first opening; a tub positioned in the inside of the cabinet, and including a second opening and a protruding rib extending toward a center of the second opening; and a diaphragm connecting the first opening with the second opening, and including a first flange fixed on an outer surface of the tub and a second flange coupled with the protruding rib.

The protruding rib may be formed along a circumference of the second opening.

The protruding rib may include: an inner surface facing the inside of the tub; and an outer surface facing the outside of the tub, wherein the second flange is coupled with the protruding rib to surround the inner surface and the outer surface of the protruding rib.

The tub may include: a tub body; and a tub lip portion extending from the tub body to participate in coupling with the diaphragm, and defining the second opening, wherein the first flange and the second flange form a tub lip accommodating space accommodating a part of the tub lip portion, and the tub lip accommodating space includes a protruding rib accommodating space formed by bending the second flange.

The tub lip portion may include: a first lip portion participating in coupling with the first flange; and a second lip portion participating in coupling with the second flange and including the protruding rib and a resting rib on which the second flange coupled with the protruding rib is rested.

The resting rib may include a resting surface on which the second flange is rested, and extend toward the inside of the tub from the protruding rib.

In the first lip portion, a recess may be formed in which a portion of the first flange is inserted and fixed.

The washing machine may further include a fixing member fixing the first flange on the tub.

In accordance with an aspect of the disclosure, a washing machine includes: a cabinet including a first opening; a tub positioned in the inside of the cabinet, and including a second opening; and a diaphragm connecting the first opening with the second opening, and including a cabinet coupling portion coupled with the cabinet and a tub coupling portion coupled with the tub, wherein in at least one of the cabinet and the tub, at least one of a first protruding rib extending from the cabinet toward the center of the first opening such that the cabinet coupling portion is coupled with the first protruding rib, and a second protruding rib extending from the tub toward the center of the second opening such that the tub coupling portion is coupled with the second protruding rib is formed.

The first protruding rib may be formed along a circumference of the first opening, and the second protruding rib may be formed along a circumference of the second opening.

The cabinet coupling portion may be coupled with the first protruding rib to surround the first protruding rib, and the tub coupling portion may be coupled with the second protruding rib to surround the second protruding rib.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, embodiments of the present disclosure will be described in detail with reference to the appended drawings. In the following description, the terms "front end", "rear end", "upper portion", "lower portion", "upper end", and "lower end" are defined based on the drawings, and the shapes and positions of the corresponding components are not limited by the terms.

Figure 1:
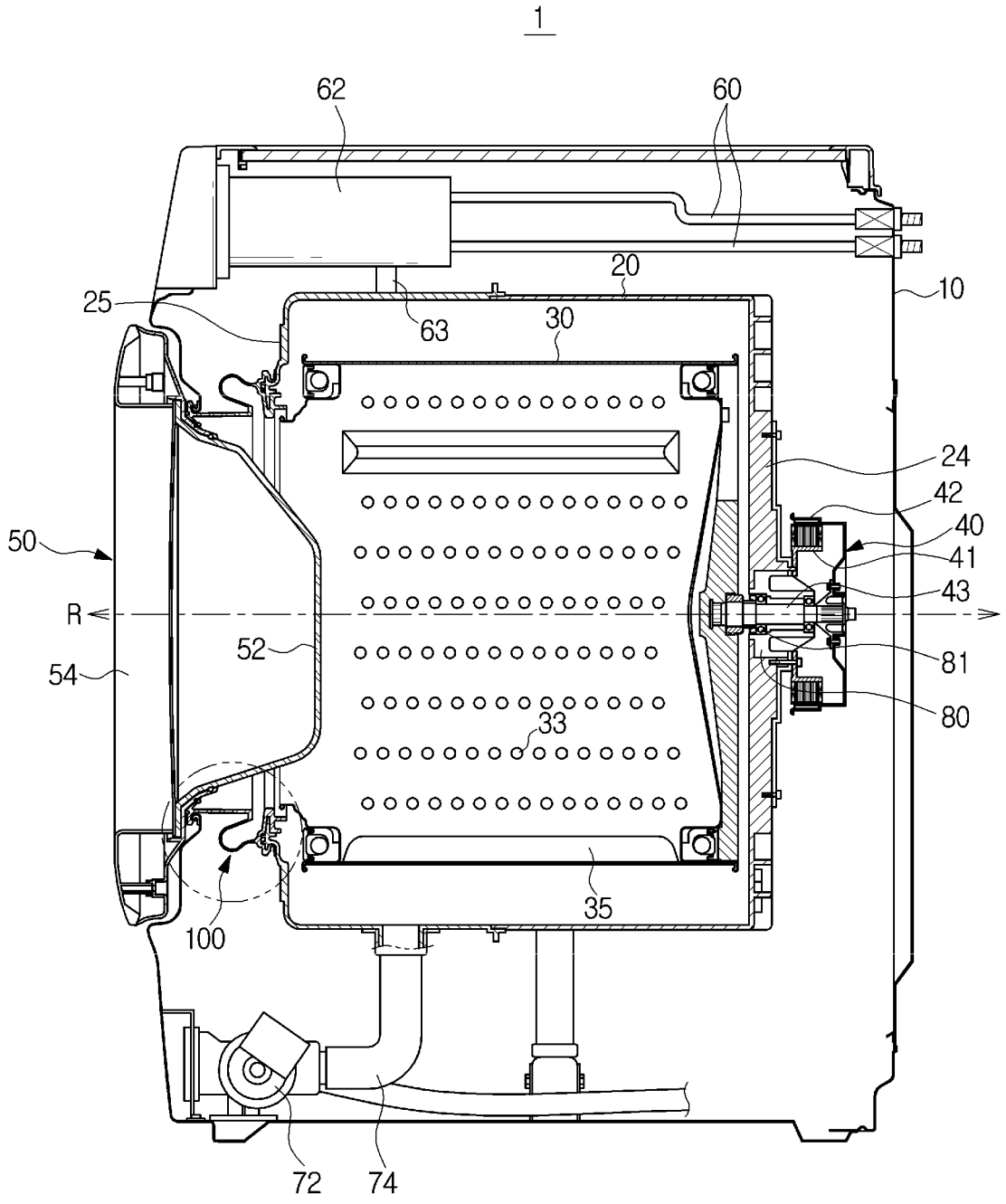
FIG. 1 is a cross-sectional view of a washing machine according to an embodiment of the disclosure.
Figure 2:
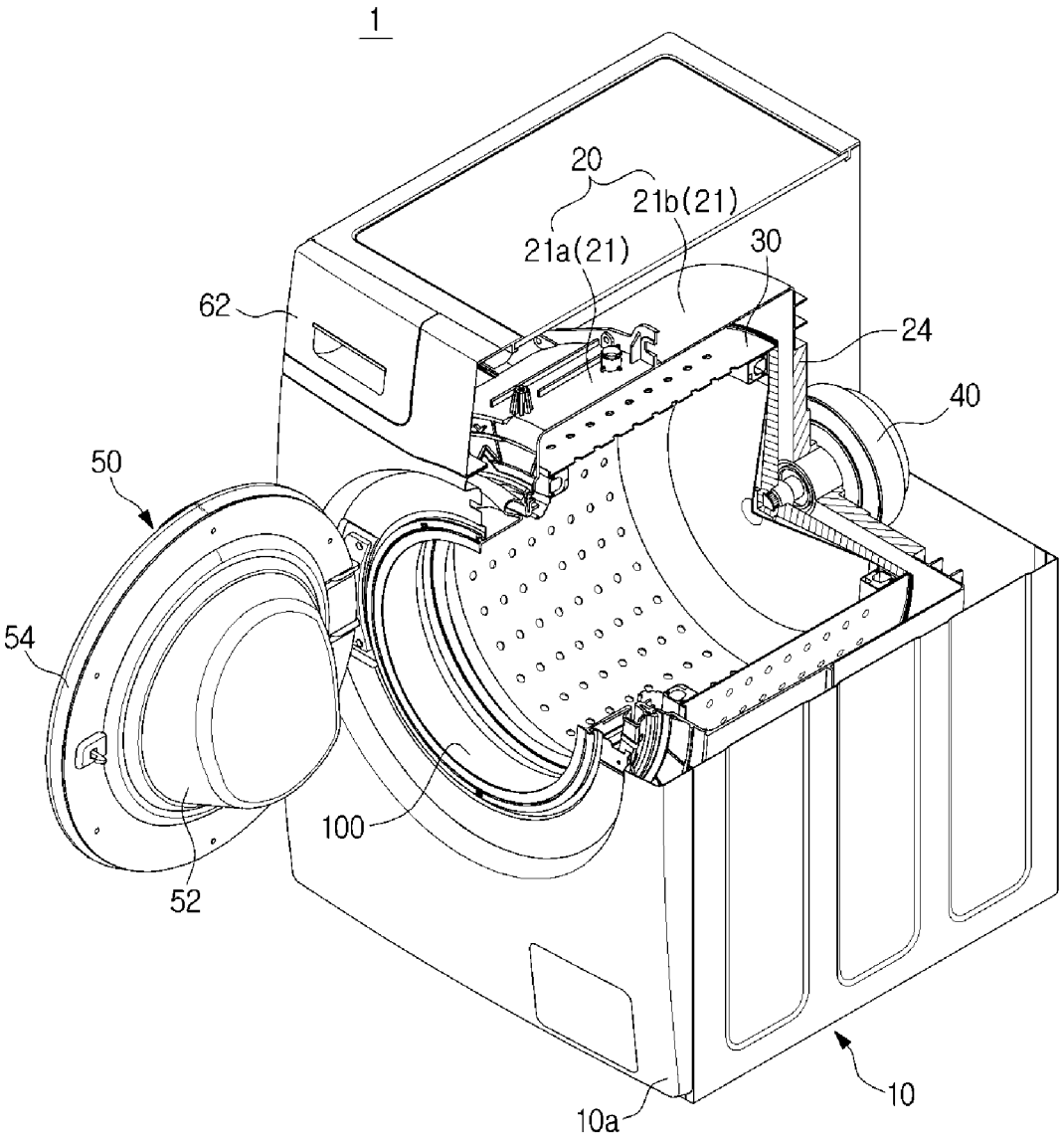
FIG. 2 is a perspective view showing a cross section of a portion of a washing machine according to an embodiment of the disclosure.
Figure 3:
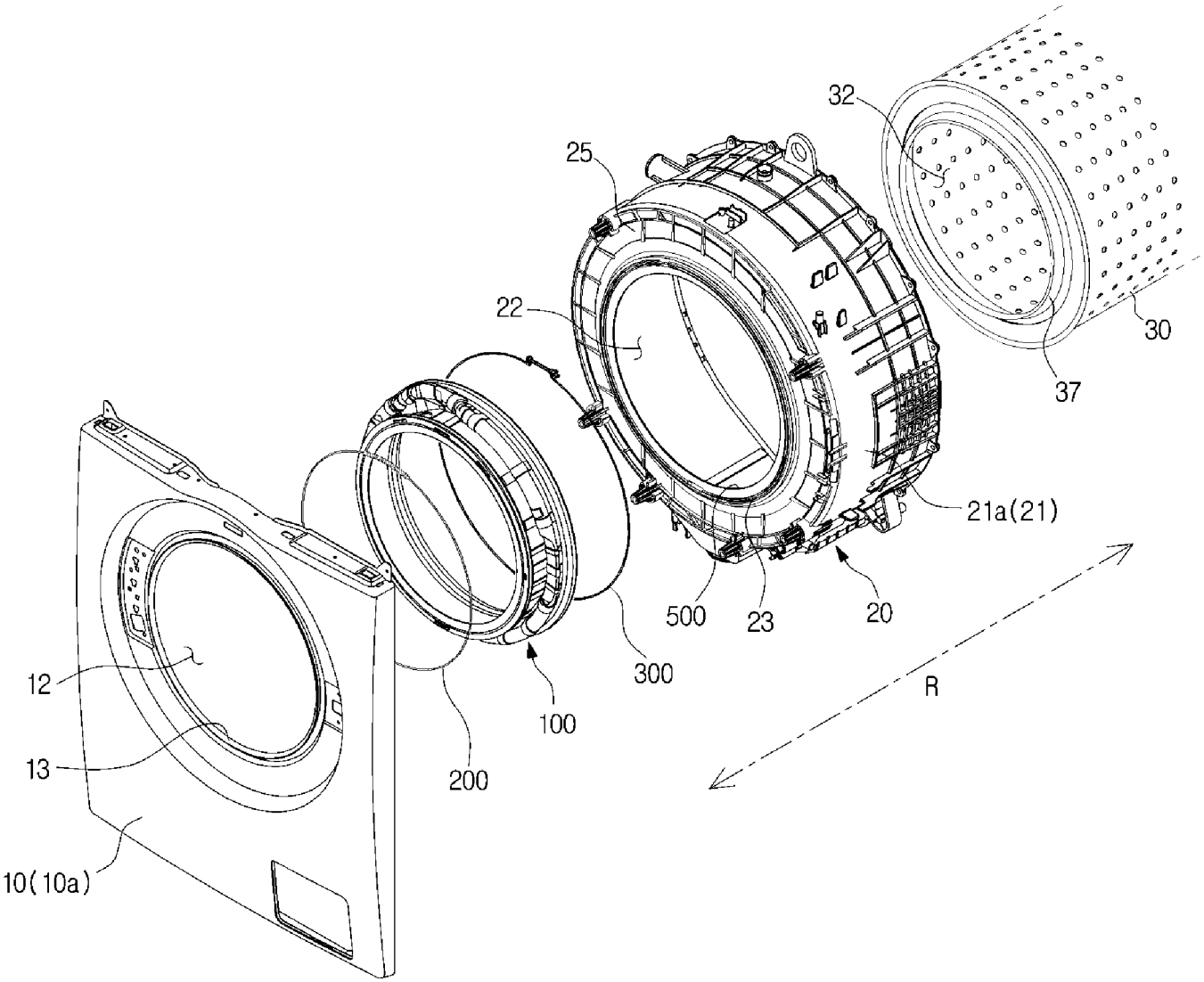
FIG. 3 is an exploded perspective view of a portion of a washing machine according to an embodiment of the disclosure.

FIG. 1 is a cross-sectional view of a washing machine according to an embodiment of the disclosure, FIG. 2 is a perspective view showing a cross section of a part of a washing machine according to an embodiment of the disclosure, and FIG. 3 is an exploded perspective view of a part of a washing machine according to an embodiment of the disclosure.

As shown in FIGS. 1 to 3, a washing machine 1 may include a cabinet 10 forming an outer appearance of the washing machine 1, a tub 20 positioned in the inside of the cabinet 10 to store washing water, a drum 30 rotatably positioned in the inside of the tub 20, and a driving motor 40 for driving the drum 30.

The cabinet 10 may include a front frame 10*a* forming a front outer appearance of the washing machine 1. More specifically, the front frame 10*a* of the cabinet 10 may form a front outer appearance of the washing machine 1 together with a door 50. The cabinet 10 may further include a cabinet lip portion 13 extending from the front frame 10*a* to participate in coupling with a diaphragm 100.

The cabinet 10 may include a first opening 12. More specifically, the front frame 10*a* of the cabinet 10 may include the first opening 12. The first opening 12 of the front frame 10*a* may be opened or closed by the door 50.

The tub 20 may include a tub body 21. The tub body 21 may include a front tub 21*a* and a rear tub 21*b*. The tub body 21 may be formed by coupling the front tub 21*a* with the rear tub 21*b*. However, the tub body 21 may be formed as a single component into which the front tub 21*a* and the rear tub 21*b* are integrated, instead of being formed by coupling separate components, such as the front tub 21*a* and the rear tub 21*b*. The tub body 21 may be in the shape of a cylinder. However, the tub body 21 is not limited to the example, and may change variously.

The tub 20 may further include a second opening 22. The second opening 22 may be formed in the front tub 21*a* to correspond to the first opening 12 of the cabinet 10.

The tub 20 may further include a tub lip portion 23 extending from the tub body 21 to participate in coupling with the diaphragm 100. The tub lip portion 23 may be positioned in the front tub 21*a* to define the second opening 22 of the tub 20. The tub lip portion 23 will be described in detail, later.

The drum 30 may be positioned in the inside of the tub 20 in such a way to be rotatable with respect to a rotating axis. The drum 30 may be in the shape of a cylinder. However, the shape of the drum 30 is not limited to the example, and may change variously.

The drum 30 may include a third opening 32. The third opening 32 may be formed to correspond to the first opening 12 of the cabinet 10 and the second opening 22 of the tub 20. Laundry may be put into the inside of the drum 30 through the first opening 12 of the cabinet 10, the second opening 22 of the tub 20, and the third opening 32 of the drum 30.

The drum 30 may further include a drum lip portion 37 forming a circumference of the third opening 32.

In the drum 30, a plurality of through holes 33 may be formed to pass washing water through the drum 30. On an inner circumferential surface of the drum 30, a lifter 35 may be provided to raise and drop laundry when the drum 30 rotates.

The driving motor 40 may be installed on a rear wall 24 of the tub 20. That is, the driving motor 40 may be installed on the rear tub 21*b*. The driving motor 40 may include a stator 41 fixed on the tub 20, a rotor 42 rotatably positioned around the stator 41, and a driving shaft 43 for transferring torque of the driving motor 40 to the drum 30. The rotor 42 may electromagnetically interact with the stator 41 to rotate, and transfer torque to the driving shaft 43. One end of the driving shaft 43 may be coupled with the drum 30, and the other end of the driving shaft 43 may be coupled with the rotor 42. More specifically, the other end of the driving shaft 43 may extend outward from the rear wall 24 of the tub 20 to be coupled with the rotor 42. The rotor 42 may be rotatable on the driving shaft 43. The rotating axis of the drum 30 may be implemented by the driving shaft 43. In other words, the rotating axis of the drum 30 may be located on the same line as the driving shaft 43.

On the rear wall 24 of the tub 20, a bearing housing 80 may be installed to rotatably support the driving shaft 43. That is, in the rear tub 21*b*, the bearing housing 80 may be installed to rotatably support the driving shaft 43. The bearing housing 80 may be made of an aluminium alloy, and when the tub 20 is injection-molded, the bearing housing 80 may be inserted into the rear wall 24 of the tub 20. A plurality of bearings 81 may be installed between the bearing housing 80 and the driving shaft 43 to smoothly rotate the driving shaft 43.

The washing machine 1 may further include the door 50 for opening and closing the first opening 12 of the cabinet 10. The door 50 may be rotatably installed on the cabinet 10. The door 50 may include a door glass 52 to allow a user to view the inside of the drum 30, and a door frame 54 for supporting the door glass 52.

Above the tub 20, a water supply pipe 60 for supplying washing water into the tub 20 may be installed. One end of the water supply pipe 60 may be connected to an external water supply source (not shown), and the other end of the water supply pipe 60 may be connected to a detergent supply apparatus 62. The detergent supply apparatus 62 may be connected to the tub 20 through a connecting pipe 63. Washing water supplied through the supply pipe 60 may be supplied to the inside of the tub 20 together with a detergent via the detergent supply apparatus 62.

Below the tub 20, a drain pump 72 and a drain pipe 74 for draining washing water in the inside of the tub 20 to the outside of the cabinet 10 may be installed.

The washing machine 1 may further include the diaphragm 100 installed between the tub 20 and the door 50. The diaphragm 100 may connect the first opening 12 of the cabinet 10 with the second opening 22 of the tub 20. The diaphragm 100 may form a passage arriving at the third opening 32 of the drum 30 from the first opening 12 of the cabinet 10. The diaphragm 100 may function to reduce vibrations transferred from the tub 20 to the front frame 10*a* of the cabinet 10 when the drum 30 rotates. Also, because a portion of the diaphragm 100 is positioned between the door 50 and the front frame 10*a*, the diaphragm 100 may prevent washing water in the inside of the tub 20 from leaking out of the cabinet 10.

The diaphragm 100 may be an injection-molded product molded with a thermoplastic elastomer. Because the thermoplastic elastomer has elasticity at a room temperature like rubber, the diaphragm 100 formed with the thermoplastic elastomer may effectively reduce vibrations that are transferred from the tub 20 to the front frame 10*a* of the cabinet 10.

The washing machine 1 may further include a first fixing member 200 for fixing the diaphragm 100 on the cabinet 10. More specifically, the first fixing member 200 may fix a cabinet coupling portion 130 (see FIG. 7) of the diaphragm 100 on the cabinet lip portion 13 forming a circumference of the first opening 12 of the front frame 10*a*. The first fixing member 200 may be a wire in the shape of a ring. The first fixing member 200 may be made of a metal material. However, the shape and material of the first fixing member 200 are not limited to the example, and may change variously.

The washing machine 1 may further include a second fixing member 300 for fixing the diaphragm 100 on the tub 20. More specifically, the second fixing member 300 may fix a tub coupling portion 140 of the diaphragm 100 on the tub lip portion 23 forming a circumference of the second opening 22 of the tub 20. The second fixing member 300 may be a wire in the shape of a ring. The second fixing member 300 may be made of a metal material. However, the shape and material of the second fixing member 300 are not limited to the example, and may change variously.

When the tub coupling portion 140 of the diaphragm 100 is fixed on the tub 20 through the second fixing member 300, it may be difficult to effectively prevent movements of the diaphragm 100. That is, when the tub coupling portion 140 of the diaphragm 100 is fixed on the tub 20 through the second fixing member 300, it may be difficult to implement rigid coupling between the diaphragm 100 and the tub 20, and an interval between the diaphragm 100 and the drum 30, that is, an interval between the diaphragm 100 and the drum lip portion 37 may be excessively widened, which may result in damage of laundry, damage of the diaphragm 100, a failure of the washing machine 1, etc.

Hereinafter, to address the above problems, a method for fixing the tub coupling portion 140 of the diaphragm 100 on the tub 20 at a plurality of locations will be described in detail.

Figure 4:
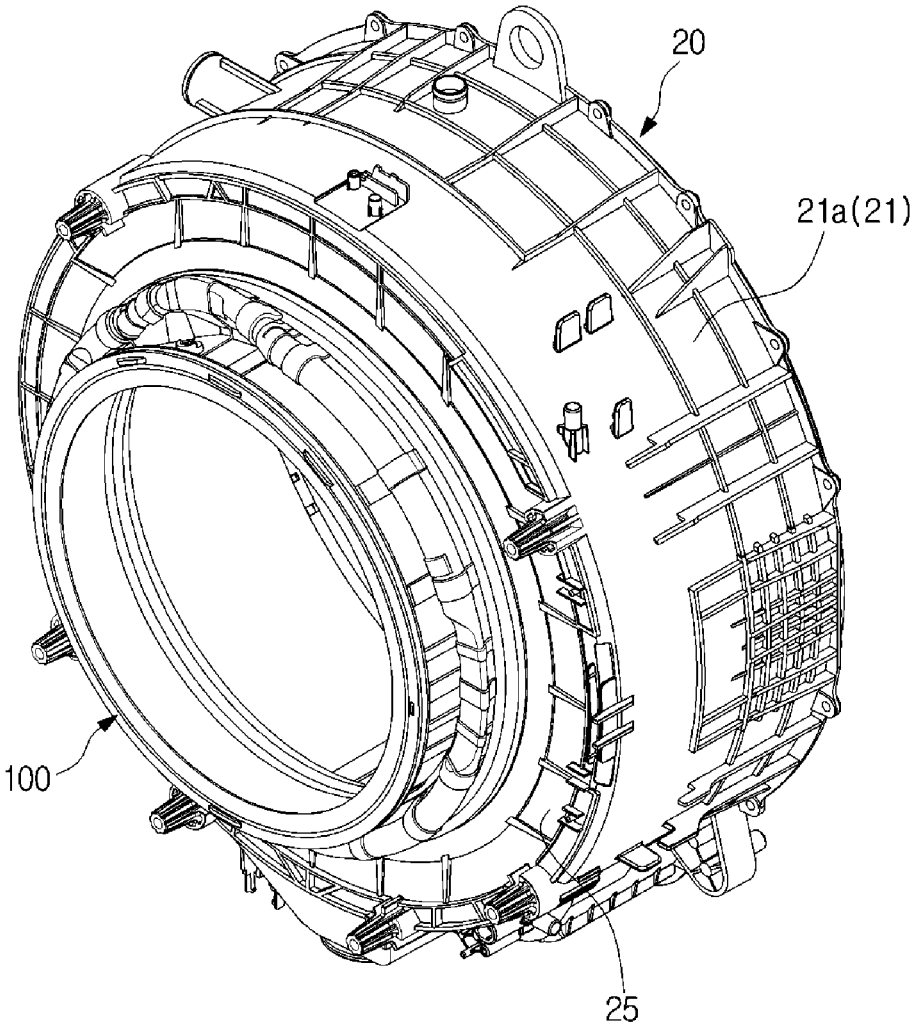
FIG. 4 shows a state in which a diaphragm is coupled with a tub in a washing machine according to an embodiment of the disclosure.
Figure 5:
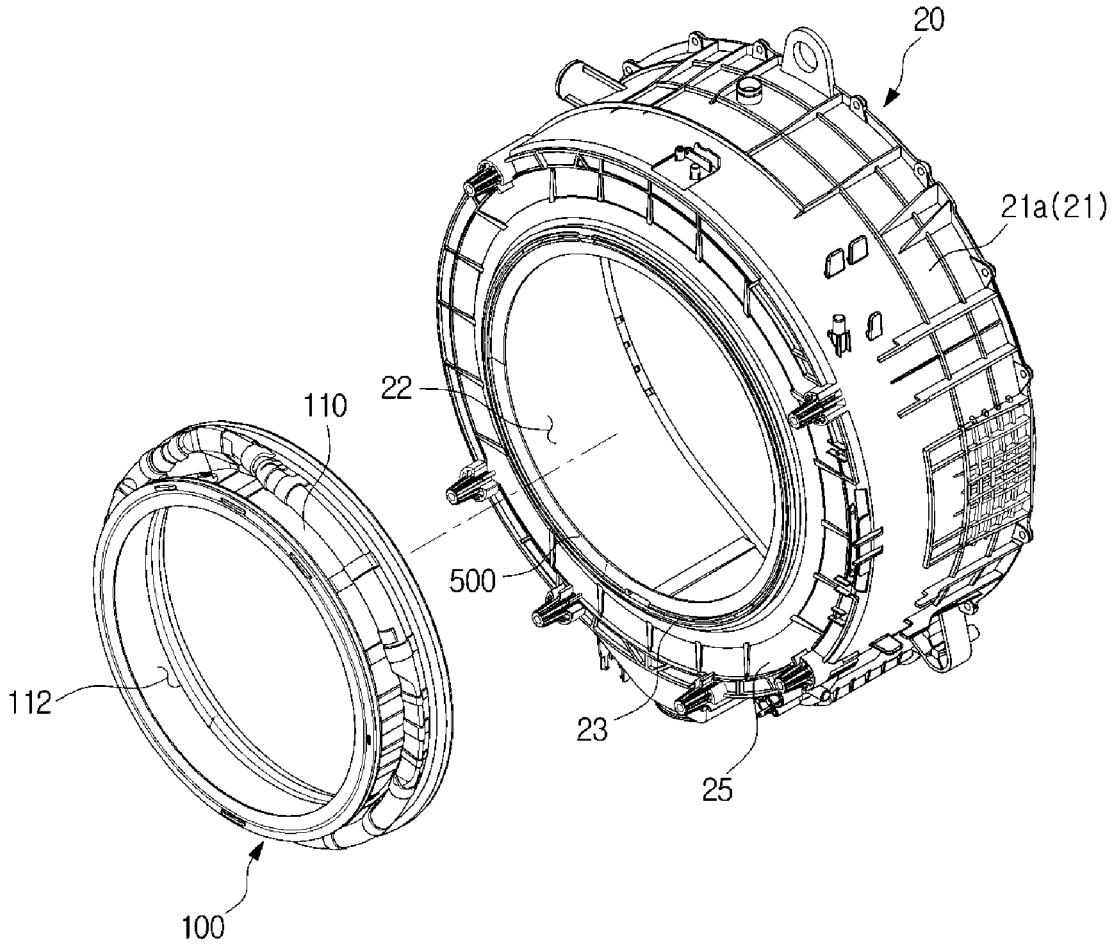
FIG. 5 shows a state in which a diaphragm is separated from a tub in a washing machine according to an embodiment of the disclosure.
Figure 6:
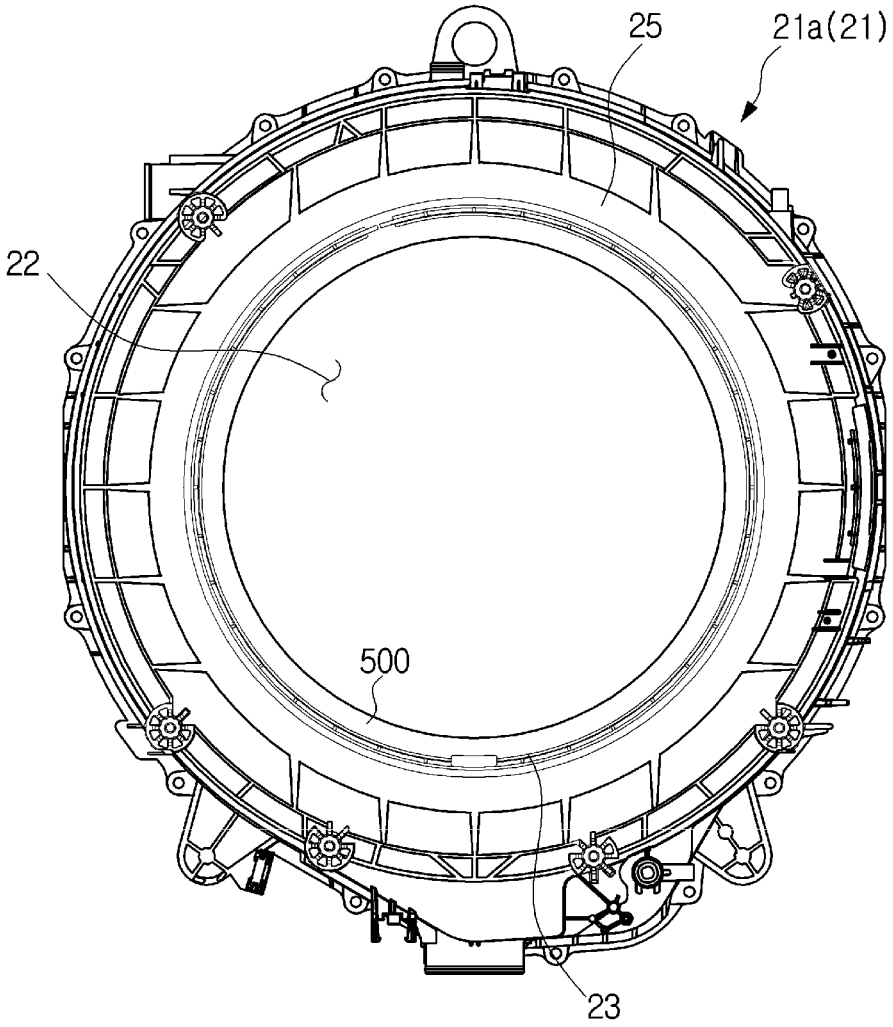
FIG. 6 is a front view of a tub in a washing machine according to an embodiment of the disclosure.
Figure 7:
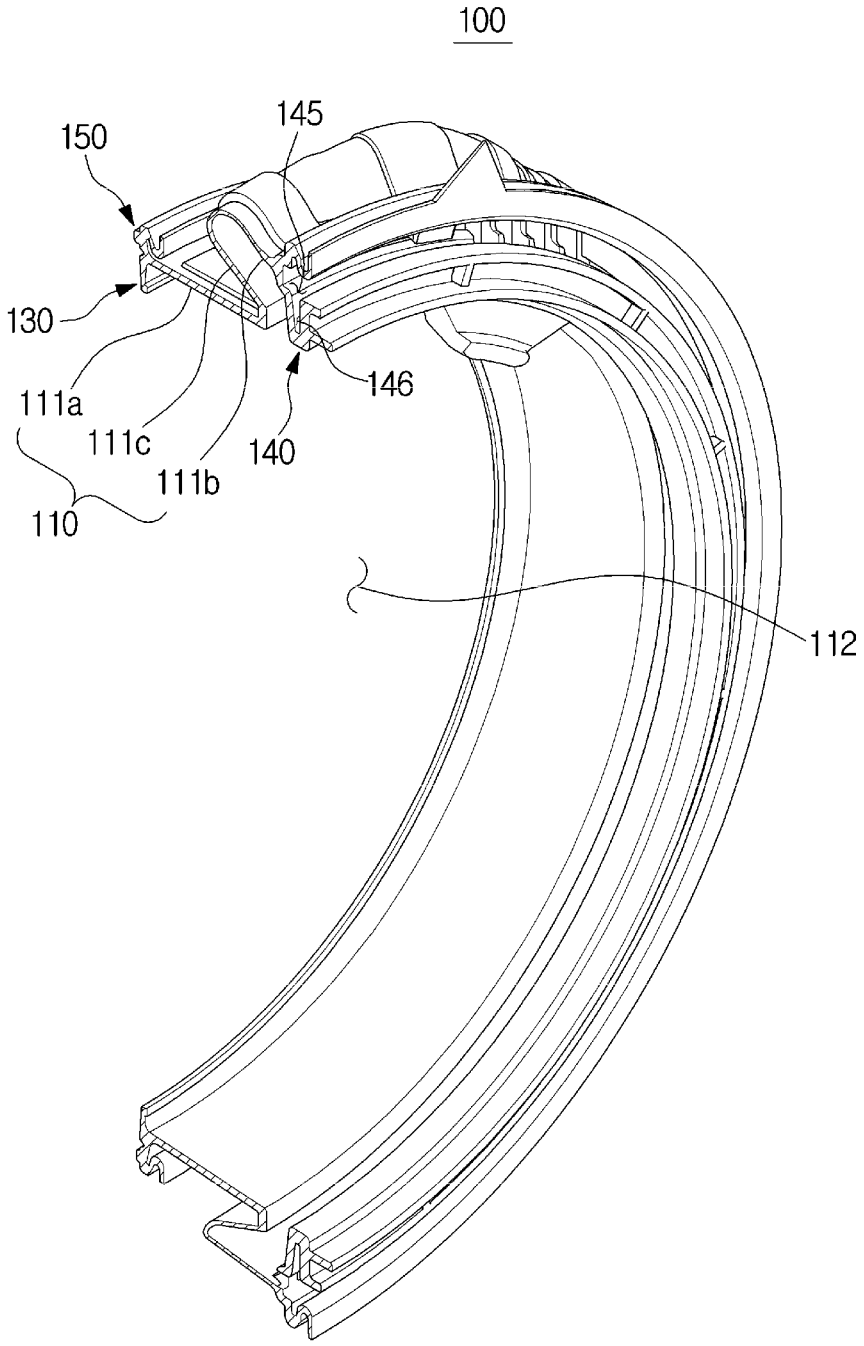
FIG. 7 is a rear perspective view showing a cross section of a diaphragm in a washing machine according to an embodiment of the disclosure.
Figure 8:
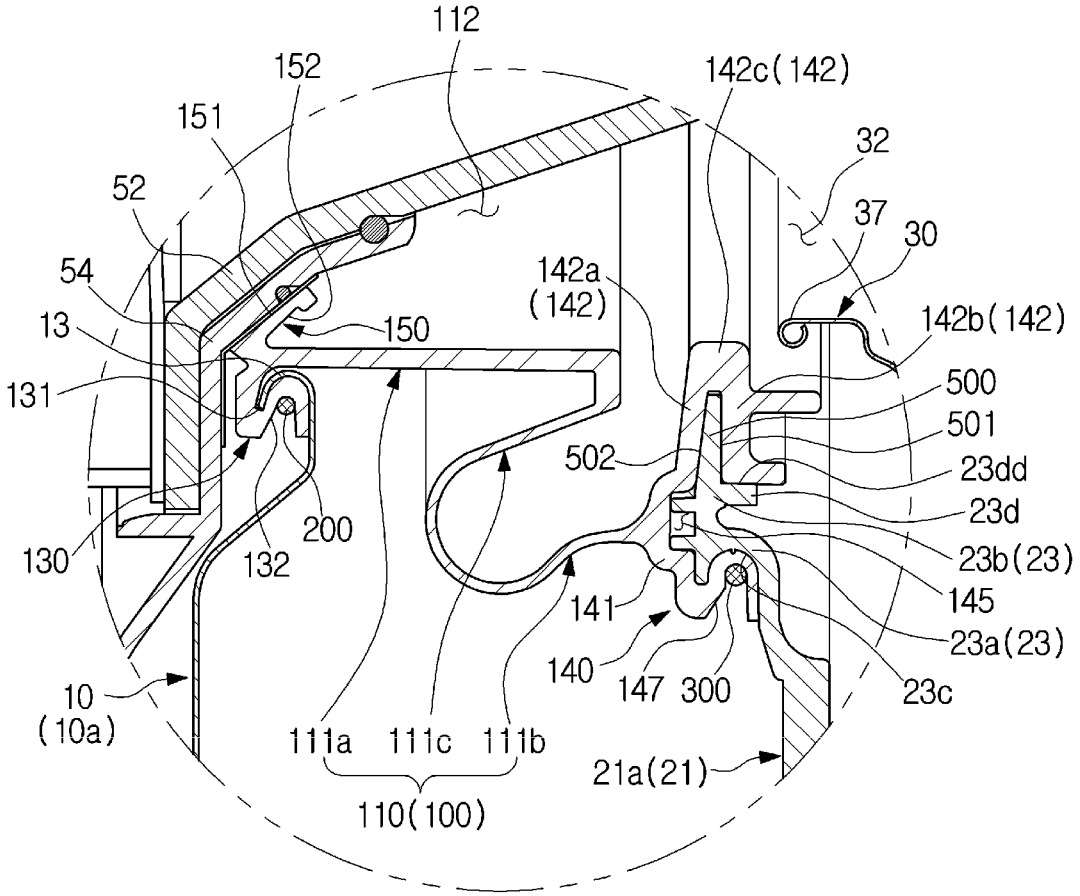
FIG. 8 is an enlarged view of a portion of FIG. 1.

FIG. 4 shows a state in which a diaphragm is coupled with a tub in a washing machine according to an embodiment of the disclosure, FIG. 5 shows a state in which a diaphragm is separated from a tub in a washing machine according to an embodiment of the disclosure, FIG. 6 is a front view of a tub in a washing machine according to an embodiment of the disclosure, FIG. 7 is a rear perspective view showing a cross section of a diaphragm in a washing machine according to an embodiment of the disclosure, and FIG. 8 is an enlarged view of a portion of FIG. 1.

As shown in FIGS. 4 to 8, the tub 20 may include a protruding rib 500. The protruding rib 500 may be formed in the front tub 21*a*. The protruding rib 500 may extend toward a center of the second opening 22 of the tub 20. More specifically, the protruding rib 500 may extend from a front wall 25 of the tub 20 corresponding to the rear wall 24 of the tub 20 toward the center of the second opening 22 of the tub 20.

The protruding rib 500 may include an inner surface 501 facing the inside of the tub 20 and an outer surface 502 facing the outside of the tub 20.

The protruding rib 500 may be formed along the circumference of the second opening 22 of the tub 20. According to an aspect, an edge of the second opening 22 may be defined by the protruding rib 500.

As shown in FIG. 6, the protruding rib 500 may extend continuously along the circumference of the second opening 22. That is, the protruding rib 500 may be in the shape of a closed loop. However, the shape of the protruding rib 500 is not limited to the example as long as the protruding rib 500 extends toward the center of the second opening 22 of the tub 20 from the front wall 25 of the tub 20. For example, the protruding rib 500 may be formed discontinuously along the circumference of the second opening 22 of the tub 20.

The protruding rib 500 may be integrated into the tub 20. More specifically, the protruding rib 500 may be integrated into the front tub 21*a*. However, the protruding rib 500 may be a component that is separated from the tub 20 and coupled with the tub 20.

The tub coupling portion 140 of the diaphragm 100 may be fixed on the tub 20 at a plurality of locations. More specifically, one end of the tub coupling portion 140 of the diaphragm 100 may be fixed at a first location of the tub 20 by the second fixing member 300, and the other end of the tub coupling portion 140 of the diaphragm 100 may be coupled with the protruding rib 500 and fixed at a second location of the tub 20. As such, when the tub coupling portion 140 of the diaphragm 100 is fixed on the tub 20 at a plurality of locations, the diaphragm 100 may be effectively prevented from moving, and an interval between the diaphragm 100 and the third opening 32 of the drum 30 may be maintained uniform. In other words, when the tub coupling portion 140 of the diaphragm 100 is fixed on the tub 20 at a plurality of locations, the diaphragm 100 may be effectively prevented from moving, and a gap between the diaphragm 100 and the drum lip portion 37 of the drum 30 may be maintained substantially uniform.

The diaphragm 100 may be positioned between the first opening 12 of the front frame 10*a* and the third opening 32 of the drum 30. The diaphragm 100 may be in the shape of a ring. However, the shape of the diaphragm 100 is not limited to the example, and may change variously.

The diaphragm 100 may include a cavity 112 and a diaphragm body 110 defining the cavity 112. The diaphragm 100 may be positioned such that the cavity 112 corresponds to the first opening 12, the second opening 22, and the third opening 32. When the first opening 12 of the cabinet 10 is closed by the door 50, a portion of the door 50 may be accommodated in the cavity 112 of the diaphragm 100.

The diaphragm body 110 may include a first body 111*a* and a second body 111*b*. The first body 111*a* may be adjacent to the front frame 10*a*. That is, the first body 111*a* may be positioned adjacent to the front frame 10*a*. That is, the first body 111*a* may be positioned in front of the second body 111*b* to be adjacent to the front frame 10*a*. The first body 111*a* may be coupled with the cabinet lip portion 13, and the second body 111*b* may be coupled with the tub lip portion 23.

The diaphragm body 110 may further include a connecting portion 111*c* connecting the first body 111*a* with the second body 111*b*. The connecting portion 111*c* may have a structure bent at least one time to effectively reduce vibrations that are transferred from the tub 20 to the cabinet 10.

The diaphragm 100 may further include the cabinet coupling portion 130 that is adjacent to the first opening 12 of the cabinet 10, and the tub coupling portion 140 that is adjacent to the second opening 22 of the tub 20. The cabinet coupling portion 130 may be positioned at one end of the diaphragm body 110 that is adjacent to the first opening 12 of the cabinet 10, and the tub coupling portion 140 may be positioned at the other end of the diaphragm body 110 that is adjacent to the second opening 22 of the tub 20. In other words, the cabinet coupling portion 130 may be positioned at a front end portion of the first body 111*a*, and the tub coupling portion 140 may be positioned at a rear end portion of the second body 111*b*.

The cabinet coupling portion 130 may include a cabinet coupling groove 131 and a first fixing groove 132 located behind the cabinet coupling groove 131. The cabinet lip portion 13 forming the first opening 12 may be coupled with the cabinet coupling groove 131. The first fixing member 200 may be inserted in the first fixing groove 132 to prevent the diaphragm 100 from being separated from the cabinet 10.

The diaphragm 100 may further include a diaphragm lip portion 150 formed in the front end portion of the first body 111*a*. A front surface 151 of the diaphragm lip portion 150 may face the door 50, and a rear surface 152 of the diaphragm lip portion 150 may face the drum 30. When the first opening 12 of the cabinet 10 is closed by the door 50, the front surface 151 of the diaphragm lip portion 150 may contact the door frame 54 to seal the door frame 54, thereby preventing washing water from leaking between the door 50 and the front frame 10*a*.

The tub coupling portion 140 may include a first flange 141 and a second flange 142. The first flange 141 and the second flange 142 may be coupled with the tub 20. More specifically, the first flange 141 may be fixed on an outer surface of the tub 20. That is, the first flange 141 may be fixed on the tub 20 by the second fixing member 300. The second flange 142 may be coupled with the protruding rib 500 and fixed on the tub 20.

The second flange 142 may include a first extension portion 142*a* contacting the outer surface 502 of the protruding rib 500, a second extension portion 142*b* contacting the inner surface 501 of the protruding rib 500, and a third extension portion 142*c* forming a protruding rib accommodating space 146 accommodating the protruding rib 500 together with the first extension portion 142*a* and the second extension portion 142*b*.

The second flange 142 may be coupled with the protruding rib 500 to surround the protruding rib 500. In other words, the second flange 142 may be coupled with the protruding rib 500 to surround the inner surface 501 and the outer surface 502 of the protruding rib 500.

The tub coupling portion 140 may further include a tub lip accommodating space 145. The tub lip accommodating space 145 may be formed by the first flange 141 and the second flange 142. In other words, the tub lip accommodating space 145 may be formed between the first flange 141 and the second flange 142. A part of the tub lip portion 23 may be accommodated in the tub lip accommodating space 145. The tub lip accommodating space 145 may include the protruding rib accommodating space 146 formed by bending the second flange 142. The protruding rib 500 may be accommodated in the protruding rib accommodating space 146.

The tub lip portion 23 may include a first lip portion 23*a* participating in coupling with the first flange 141 of the tub coupling portion 140 and a second lip portion 23*b* participating in coupling with the second flange 142 of the tub coupling portion 140.

In the first lip portion 23*a*, a recess 23*c* may be formed in which a portion of the first flange 141 is inserted and fixed. The portion of the first flange 141, defining a second fixing groove 147 which will be described later, may be inserted and fixed in the recess 23*c* by the second fixing member 300.

The second lip portion 23*b* may be positioned in an inner area of the tub 20 than the first lip portion 23*a*. The second lip portion 23*b* may include the protruding rib 500 and a resting rib 23*d* on which the second flange 142 of the tub coupling portion 140 coupled with the protruding rib 500 is rested. The resting rib 23*d* may have a resting surface 23*dd* on which the second flange 142 is rested. The resting rib 23*d* may extend toward the inside of the tub 20 from the protruding rib 500. Preferably, the resting rib 23*d* may extend toward the inside of the tub 20 in a rotating-axis direction R (see FIG. 1) of the drum 30 from the protruding rib 500. The second flange 142 of the tub coupling portion 140 coupled with the protruding rib 500 may be bent and rested on the resting rib 23*d*.

The tub coupling portion 140 may further include the second fixing groove 147. The second fixing groove 147 may be formed in the first flange 141. The second fixing member 300 may be coupled with the second fixing groove 147 to prevent the diaphragm 100 from being separated from the tub 20. That is, the second fixing member 300 may be inserted in the second fixing groove 147 to prevent the first flange 141 from being separated from the tub 20.

Figure 9:
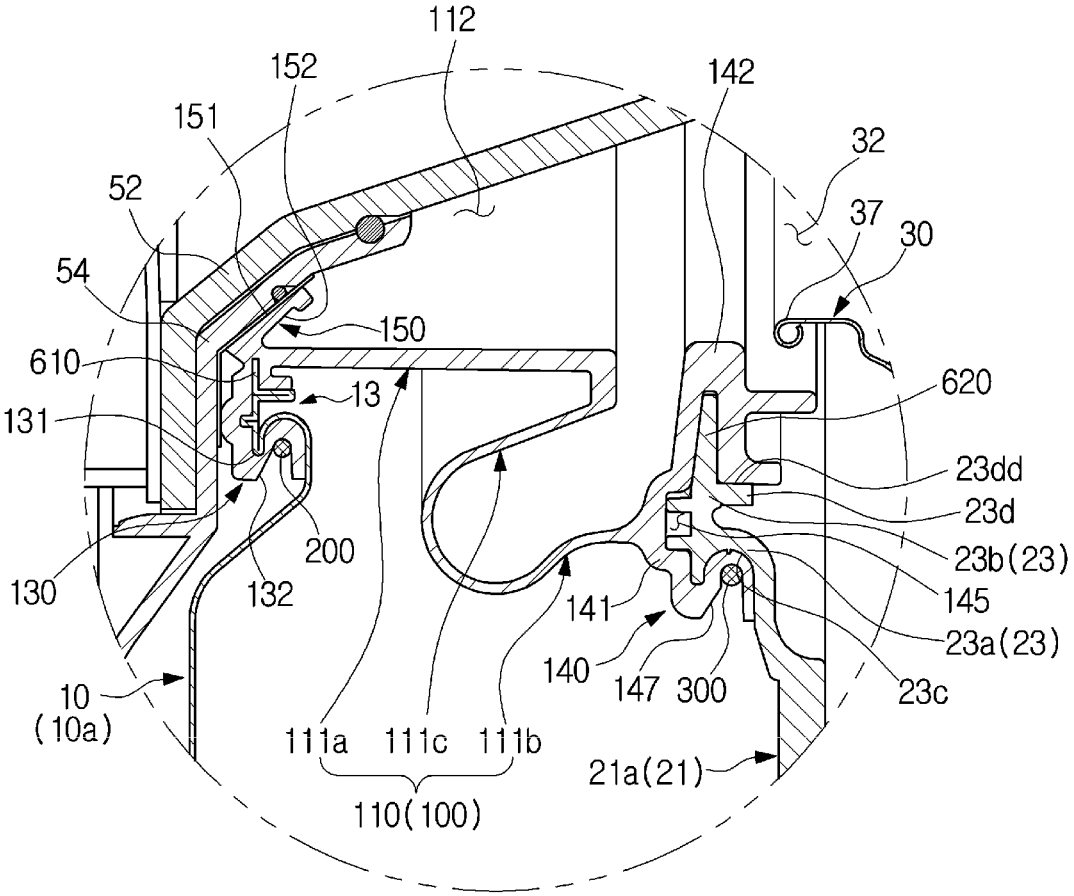
FIG. 9 is an enlarged view of a portion in a washing machine according to an embodiment of the disclosure.

FIG. 9 is an enlarged view of a portion in a washing machine according to an embodiment of the disclosure. Hereinafter, descriptions overlapping with those given above with reference to FIGS. 1 to 8 will be omitted.

As shown in FIG. 9, a protruding rib may be formed on at least one of the cabinet 10 and the tub 20. More specifically, at least one of a first protruding rib 610 and a second protruding rib 620 may be formed in at least one of the cabinet 10 and the tub 20. The first protruding rib 610 may extend from the cabinet 10 toward the center of the first opening 12 of the cabinet 10 such that the cabinet coupling portion 130 of the diaphragm 100 is coupled with the first protruding rib 610. In other words, the first protruding rib 610 may extend from the front frame 10*a* toward the center of the first opening 12 of the front frame 10*a* such that the cabinet coupling portion 130 of the diaphragm 100 is coupled with the first protruding rib 610. The second protruding rib 620 may extend from the tub 20 toward the center of the second opening 22 of the tub 20 such that the tub coupling portion 140 of the diaphragm 100 is coupled with the second protruding rib 620.

The first protruding rib 610 may be formed along the circumference of the first opening 12. More specifically, the first protruding rib 610 may be formed continuously along the circumference of the first opening 12. That is, the first protruding rib 610 may be in the shape of a closed loop. However, the shape of the first protruding rib 610 is not limited to the example, and may change variously.

The second protruding rib 620 may be formed along the circumference of the second opening 22. The second protruding rib 620 may be the same as the protruding rib 500 described above with reference to FIGS. 1 to 8, and therefore, descriptions about the second protruding rib 620 will be omitted.

The cabinet coupling portion 130 may be coupled with the first protruding rib 610 to surround the first protruding rib 610.

The tub coupling portion 140 may be coupled with the second protruding rib 620 to surround the second protruding rib 620. The coupling of the tub coupling portion 140 with the second protruding rib 620 is the same as coupling of the tub coupling portion 140 with the protruding rib 500 as described above with reference to FIGS. 1 to 8, and therefore, a detailed description thereof will be omitted.

The cabinet lip portion 13 may have a shape that is similar to that of the tub lip portion 23. However, the shape of the cabinet lip portion 13 is not limited to the example as long as the cabinet lip portion 13 includes the first protruding rib 610.

As such, a protruding rib may be formed in the front frame 10*a* as well as in the tub 20 to prevent the diaphragm 100 from moving. Coupling between the front frame 10*a* and the diaphragm 100 may become firm when one end of the cabinet coupling portion 120 is fixed on the front frame 10*a* by the first fixing member 200 and the other end of the cabinet coupling portion 130 is coupled with the first protruding rib 610.

By fixing the diaphragm to the tub at a plurality of locations, an interval between the diaphragm and the drum may be maintained uniform.

By fixing the first flange of the diaphragm on the outer surface of the tub by using the fixing member and coupling the second flange of the diaphragm with the protruding rib, the diaphragm may be firmly coupled with the tub, thereby being efficiently prevented from moving.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a cabinet including a first opening;

a tub positioned inside the cabinet, and including a second opening and a protruding rib protruding toward a center of the second opening;

a drum rotatably positioned inside the tub, and including a third opening; and a diaphragm connecting the first opening with the second opening, and including a first flange and a second flange that are coupled to the tub, wherein the first flange is fixed to an outer surface of the tub and the second flange is coupled to the protruding rib to maintain a substantially uniform gap between the diaphragm and the third opening around an outer circumference of the second opening, and wherein the tub includes a resting rib on which the second flange is rested, and the resting rib is in contact with an inner surface of the second flange.

2. The washing machine of claim 1, wherein the protruding rib is formed along the outer circumference of the second opening.

3. The washing machine of claim 2, wherein the protruding rib is formed continuously along the outer circumference of the second opening.

4. The washing machine of claim 1, wherein the second flange is coupled to the protruding rib to cover the protruding rib.

5. The washing machine of claim 1, wherein the tub further comprises:

a tub body; and a tub lip portion extending from the tub body to couple to the diaphragm, and defining the outer circumference of the second opening, wherein the tub lip portion comprises:

a first lip portion coupled to the first flange; and a second lip portion coupled to the second flange, and including the protruding rib and the resting rib.

6. The washing machine of claim 5, wherein the resting rib extends toward an inside of the tub from the protruding rib in a substantially perpendicular direction from the resting rib.

7. The washing machine of claim 5, wherein the first lip portion includes a recess in which a portion of the first flange is inserted and fixed to the first lip portion.

8. The washing machine of claim 1, wherein the protruding rib comprises:

an inner surface facing an inside of the tub; and an outer surface facing an outside of the tub, and the second flange comprises:

a first extension portion contacting the outer surface of the protruding rib;

a second extension portion contacting the inner surface of the protruding rib; and a third extension portion forming a protruding rib accommodating space accommodating the protruding rib together with the first extension portion and the second extension portion.

9. The washing machine of claim 1, further comprising a fixing member fixing the first flange to the tub.

10. A washing machine comprising:

a cabinet including a first opening;

a tub positioned inside the cabinet, and including a second opening and a protruding rib extending toward a center of the second opening; and a diaphragm connecting the first opening with the second opening, and including a first flange fixed to an outer surface of the tub and a second flange coupled to the protruding rib, wherein the tub includes a resting rib on which the second flange is rested, and the resting rib is in contact with an inner surface of the second flange.

11. The washing machine of claim 10, wherein the protruding rib is formed along an outer circumference of the second opening.

12. The washing machine of claim 10, wherein the protruding rib comprises:

an inner surface facing an inside of the tub; and an outer surface facing an outside of the tub, and wherein the second flange is coupled to the protruding rib to cover the inner surface and the outer surface of the protruding rib.

13. The washing machine of claim 10, wherein the tub comprises:

a tub body; and a tub lip portion extending from the tub body to couple to the diaphragm, and defining an outer circumference of the second opening, wherein the first flange and the second flange form a tub lip accommodating space accommodating a part of the tub lip portion, and the tub lip accommodating space includes a protruding rib accommodating space formed by a bent portion of the second flange.

14. The washing machine of claim 13, wherein the tub lip portion comprises:

a first lip portion coupled to the first flange; and a second lip portion coupled to the second flange and including the protruding rib and the resting rib.

15. The washing machine of claim 14, wherein the resting rib includes a resting surface contacting the second flange, and extends toward an inside of the tub from the protruding rib in a substantially perpendicular direction from the resting rib.

16. The washing machine of claim 14, wherein the first lip portion includes a recess in which a portion of the first flange is inserted and fixed to the first lip portion.

17. The washing machine of claim 10, further comprising a fixing member fixing the first flange to the tub.

18. A washing machine comprising:

a cabinet including a first opening;

a tub positioned inside the cabinet, and including a second opening; and a diaphragm connecting the first opening with the second opening, and including a cabinet coupling portion coupled to the cabinet and a tub coupling portion coupled to the tub, wherein at least one of the cabinet and the tub further includes a protruding rib, wherein the protruding rib includes:

a first protruding rib extending from the cabinet, the first protruding rib including:

a first portion coupled to the cabinet coupling portion and bent in a first radial direction away from the tub, and a second portion coupled to the cabinet coupling portion and bent in a second radial direction directly opposite to the first radial direction, wherein the second portion extends from the first portion toward a center of the first opening and includes a terminal part which protrudes toward the center of the first opening.

19. The washing machine of claim 18, wherein the protruding rib further includes a second protruding rib extending from the tub toward a center of the second opening such that the tub coupling portion is coupled to the second protruding rib, and the first protruding rib is formed along an outer circumference of the first opening, and the second protruding rib is formed along an outer circumference of the second opening.

20. The washing machine of claim 18, wherein the protruding rib further includes a second protruding rib extending from the tub toward a center of the second opening such that the tub coupling portion is coupled to the second protruding rib, the cabinet coupling portion is coupled to the first protruding rib to cover the first protruding rib, and the tub coupling portion is coupled to the second protruding rib to cover the second protruding rib.

* * * * *